US009766577B2

(12) United States Patent
Mine et al.

(10) Patent No.: US 9,766,577 B2
(45) Date of Patent: Sep. 19, 2017

(54) HEATING DEVICE FOR IMAGE FIXING

(75) Inventors: Ryuta Mine, Toride (JP); Toshiyuki Abe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 475 days.

(21) Appl. No.: 13/449,594

(22) Filed: Apr. 18, 2012

(65) Prior Publication Data

US 2012/0269535 A1 Oct. 25, 2012

(30) Foreign Application Priority Data

Apr. 19, 2011 (JP) ..... 2011-092972

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC ..... G03G 15/2053
USPC ..... 399/90
See application file for complete search history.

(56) References Cited

U.S. PATENT DOCUMENTS 6,323,460 B1 * 11/2001 Ohtsuka ..... G03G 15/2064 219/121.69
6,734,397 B2 * 5/2004 Kato et al. ..... 219/216
7,283,145 B2 * 10/2007 Kato et al. ..... 347/156
2003/0196999 A1 10/2003 Kato et al.
2005/0280682 A1 * 12/2005 Kato ..... B41J 11/002 347/102

FOREIGN PATENT DOCUMENTS

| | | | |
|---|---|---|---|
| CN | 1453665 | A | 11/2003 |
| JP | 10-104977 | A | 4/1998 |
| JP | 2001005313 | A | 1/2001 |
| JP | 2002075595 | A | 3/2002 |
| JP | 2002091229 | A | 3/2002 |

(Continued)

OTHER PUBLICATIONS

Mori. Machine Translation of JP2008139668. Published Jun. 2008. Accessed Jan. 15, 2015.*

(Continued)

*Primary Examiner* — Walter L Lindsay, Jr.
*Assistant Examiner* — Philip Marcus T Fadul
(74) *Attorney, Agent, or Firm* — Rossi, Kimms & McDowell LLP

(57) ABSTRACT

A heating device which has power-supply electrodes concentratedly arranged in one longitudinal end of a substrate. The substrate is disposed in a manner contained in a fixing film. An inner heating resistor formed by at least one heating resistor disposed in a manner substantially symmetrical with respect to a reference position in a lateral direction of the substrate, and an outer heating resistor formed by a plurality of heating resistors disposed farther from the reference position in the lateral direction of the substrate than the inner heating resistor is and arranged in a manner substantially symmetrical with respect to the reference position. Power-supply electrodes connected to the inner heating resistor and power-supply electrodes connected to the outer heating resistor are all disposed in the one longitudinal end of the substrate.

12 Claims, 9 Drawing Sheets

(56) References Cited

FOREIGN PATENT DOCUMENTS

| | | | |
|---|---|---|---|
| JP | 2002-296955 | A | 10/2002 |
| JP | 2006-004861 | A | 1/2006 |
| JP | 2006004860 | A | 1/2006 |
| JP | 2006091449 | A | 4/2006 |
| JP | 2008139668 | A | 6/2008 |
| JP | 2010129444 | A | 6/2010 |

OTHER PUBLICATIONS

Yoshioka et al. Translation of JP2009091229. Published Mar. 2002. Translated Oct. 2015.*
Extended European Search Report for corresponding EP 12164448.8, dated Oct. 24, 2013.
Official Action issued in CN201210114995.5 mailed Sep. 23, 2014. English translation provided.
Official Action issued in JP2011-092972, mailed Feb. 10, 2015.
Japanese Office Action issued in Japanese counterpart application No. JP2011-092972, dated Aug. 4, 2015.

* cited by examiner

HEATING DEVICE FOR IMAGE FIXING

BACKGROUND OF THE INVENTION

Field of the Invention

The present invention relates to a heating device for heating a recording material having an unfixed image formed thereon, to thereby fix the image on the recording material.

Description of the Related Art

Conventionally, a heating device based on an on-demand film heating method has been known as one of heating devices that are each used, e.g. in an electrophotographic copying machine or printer, for thermally fixing an unfixed toner image formed on a recording material, such as a transfer material or a photosensitive sheet, as a permanent fixed image (see Japanese Patent Laid-Open Publication No. 2002-296955).

A ceramic heater is employed for a heating body used in the heating device based on the film-heating method. The heating body comprises a ceramic substrate (e.g. of alumina or aluminum nitride) which is electrically resistant, heat-resistant, and excellent in thermal conductivity, and a primary circuit including a heating resistor (e.g. of silver palladium) which is pattern-shaped on the substrate e.g. by printing or baking and generates heat when electric power is supplied. The heating body is configured to generate heat with electric power supplied to the heating resistor, and its temperature rises quickly because of its generally low heat capacity.

The heat capacity of a heating device using the above-mentioned heating body is small, so that when recording materials having a small size in the longitudinal direction of the heating body continue to be thermally fixed, the temperature of portions of the heating body where the recording materials do not pass becomes higher than the other portions of the same. In this case, the temperature difference causes gloss unevenness in the longitudinal direction of the heating body. To avoid this, it is required to reduce print speed or the temperature difference.

Alternatively, a plurality of heating resistors are provided, and the temperatures of the heating body in the longitudinal direction thereof are detected by a plurality of temperature-detecting elements, whereby power supply to each of the heating resistors is controlled. More specifically, the heating body is formed by a heating resistor group comprising heating resistors that generate a large amount of heat at respective locations where a recording material of any size passes and heating resistors that generate a large amount of heat at respective locations where only a large-sized one of large-sized and small-sized recording materials passes. Then, power supply to the heating resistors is controlled using the temperature-detecting elements, whereby the heating body is configured such that it can be controlled to a predetermined temperature even when a recording material of whichever size is heated.

In the above-mentioned heating body comprising a plurality of heating resistors, a large temperature difference can be instantaneously caused between a heat generation part and a non-heat generation part within the heating body. For example, the temperature difference is caused when a heater control system or a temperature controller runs away, or when thermal runaway (abnormal temperature rise or abnormal heating) of the heating body occurs. Further, when only one heating resistor is continuously energized, a very large amount of electric power is supplied to the heating resistor, which can cause the above-mentioned temperature difference. When the temperature difference occurs, the heating body can be deformed or broken due to thermal stress. Therefore, to avoid the deformation or breakage of the heating body, it is required e.g. to add a safety element capable of very quick response, which makes the heating device complicated in construction, resulting in an increase in manufacturing costs.

To cope with this problem, there has been proposed a technique in which heating resistors are formed on a ceramic substrate such that they are arranged substantially symmetrically with respect to a substantial center position of the substrate in the lateral direction of the same (see Japanese Patent Laid-Open Publication No. 2006-004861). More specifically, the pattern of heating resistor is formed substantially symmetrically with respect to the center position of the substrate in the lateral direction, such that inner heating resistors are disposed closer to the center position, and outer heating resistors are disposed farther from the center position than the inner heating resistors are. This prevents the temperature difference within the heating body from being increased even when the control system of the ceramic heater or the temperature controller runs away or when only one of the heating resistors is continuously energized, whereby thermal stress applied to the substrate is reduced.

In recent years, improvement in the replaceability of life-limited components has been demanded for easy service operation, and this applies to a fixing film used in a heating device based on the on-demand film heating method. Further, it is desired to facilitate work for mounting a fixing film not only for replacement after delivery of a product but also in a manufacturing process before completion of the product.

However, in Japanese Patent Laid-Open Publication No. 2006-004861, a combination of connector contacts (power-supply electrodes) for supplying electric power to the outer heating resistors and connector contacts for supplying electric power to the inner heating resistors are disposed in one end of the substrate, and connector contacts as common electrodes for the inner and outer heating resistors are disposed in the other end of the substrate. Accordingly, connectors for power supply are attached to the respective opposite longitudinal ends of the substrate.

For this reason, in the case of mounting a fixing film in the heating device or removing or replacing a fixing film in the heating device in a state where both the connectors are attached to the opposite ends of the substrate, the fixing film interferes with the connectors attached to the substrate. Therefore, from whichever direction a fixing film is to be mounted to or removed from the heating body, it is required to detach an associated one of the connectors, which degrades workability. What is more, the number of times of connector attachment and detachment for mounting and removal of a fixing film sometimes increases depending on the work process, which leads not only to degraded workability but also to a lowered reliability of electrical conduction between the connectors and the connector contacts.

Further, when contriving the arrangement of the heating resistor groups or paths for routing conductor traces, it is also necessary to pay attention to securing symmetry in the lateral direction of the substrate.

SUMMARY OF THE INVENTION

The present invention provides a heating device which has power-supply electrodes collectively arranged on one side in a longitudinal direction of a substrate to thereby facilitate mounting and removal of a fixing film.

The present invention provides a heating device for heating a toner image on a sheet via a fixing film, comprising a substrate disposed such that a first direction of the substrate orthogonal to a conveying direction of the fixing film is longitudinal, a first heating resistor formed by at least one heating resistor that is disposed in a manner substantially symmetrical with respect to a predetermined reference position in a second direction orthogonal to the first direction of the substrate, and a second heating resistor formed by a plurality of heating resistors that are disposed farther from the reference position in the second direction of the substrate than the first heating resistor is and are arranged in a manner substantially symmetrical with respect to the reference position, wherein power-supply electrodes connected to the first heating resistor and power-supply electrodes connected to the second heating resistor are all disposed at one end of the substrate in the longitudinal direction.

According to the present invention, it is possible to concentratedly arrange power-supply electrodes at the one end of the substrate in the first direction to thereby facilitate mounting and removal of a fixing film.

Further features of the present invention will become apparent from the following description of exemplary embodiments with reference to the attached drawings.

DESCRIPTION OF THE EMBODIMENTS

The present invention will now be described in detail below with reference to the accompanying drawings showing an embodiment thereof.

Figure 1:
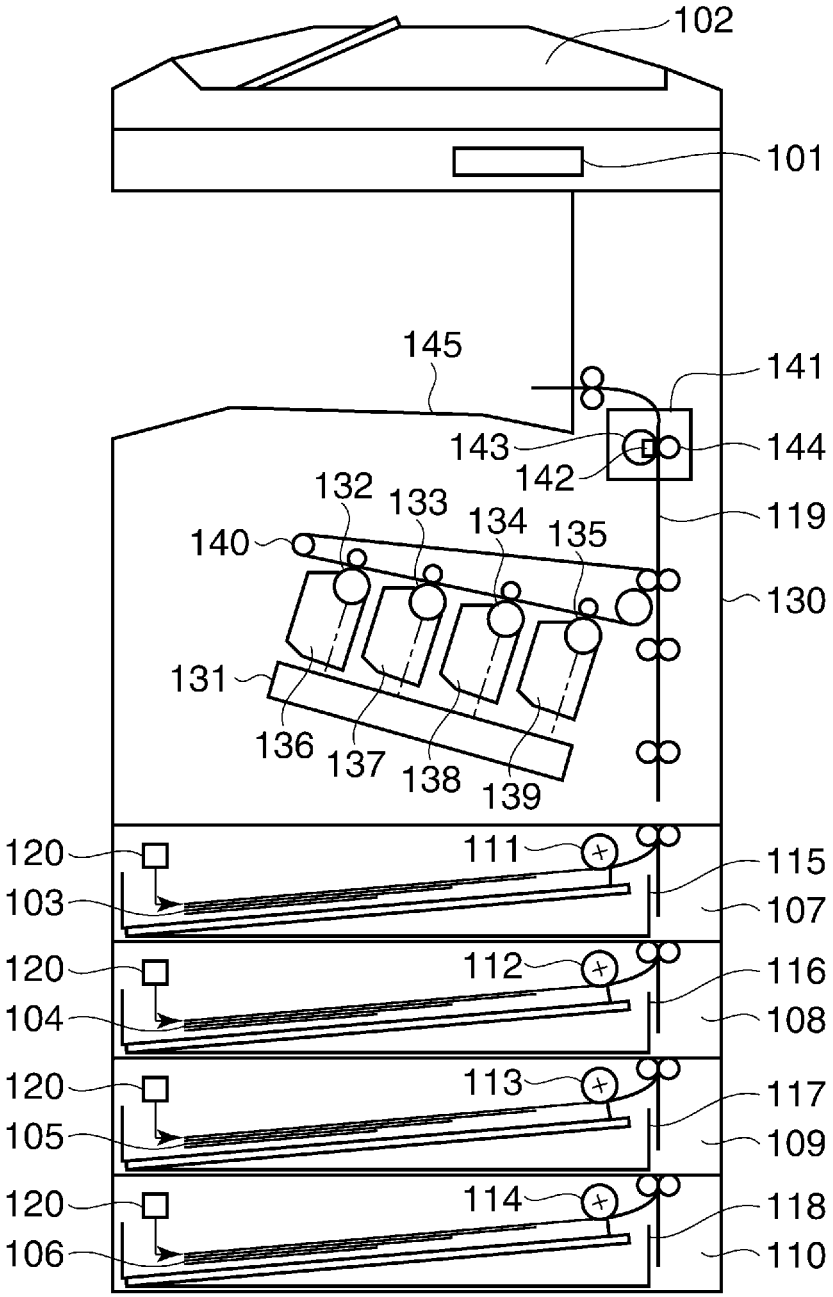
FIG. 1 is a view of an image forming apparatus to which is applied a heating device according to an embodiment of the present invention.

FIG. 1 is a view of an image forming apparatus to which is applied a heating device according to an embodiment of the present invention. The heating device is applicable to an image forming apparatus, such as an electrophotographic apparatus or an electrostatic recording apparatus. In the present embodiment, however, it is assumed that the heating device is applied to a digital multifunction peripheral, by way of example. The digital multifunction peripheral includes a thermal fixing device 141 based on the on-demand film heating method, as the heating device.

When a user operates a console section 101, a document reader 102 reads image information based on an original image and delivers a signal to the control section of the image forming apparatus 130. Sheet feed units 107 to 110 containing respective transfer sheet bundles 103 to 106 as recording materials incorporate cassettes 115 to 118, respectively. Each of the cassettes 115 to 118 is provided with a sheet size sensor 120 for detecting the sheet size of the contained transfer sheet bundle. Transfer sheets are separated from the transfer sheet bundle one by one by an associated one of pickup rollers 111 to 114 and a separation pad, not shown, in pressure contact with the pickup roller, and each separated transfer sheet is fed from the associated one of the cassettes 115 to 118 and is conveyed by a conveying unit 119 including conveying rollers and a registration roller.

The image forming apparatus 130 causes an optical unit 131 including a polygon mirror scanner motor, a laser, a lens group, etc. to operate based on the image signal obtained from the document reader 102. Then, the image forming apparatus 130 irradiates image information-based laser beams onto photosensitive drums 132, 133, 134, and 135 formed as drum-shaped electrophotographic photosensitive members associated with respective colors, to thereby form electrostatic latent images on the respective photosensitive drums 132 to 135. Thereafter, these latent images are developed by developer (hereinafter referred to as "toner"), whereby toner images are formed.

In synchronism with formation of the toner images, a transfer sheet is fed from one of the sheet feed units 107 to 110, e.g. from the sheet feed unit 107. The toner images formed on the photosensitive drums 132, 133, 134, and 135 that are integrated in respective color-specific process cartridges 136, 137, 138, and 139 are transferred onto a transfer belt 140 by applying a high voltage to the transfer belt 140. Further, the toner images transferred onto the transfer belt 140 are secondarily transferred from the transfer belt 140 onto the fed transfer sheet. The transfer sheet as a recording sheet 201 (see FIG. 2) having an image formed thereon by the secondary transfer is conveyed to the thermal fixing device 141, as a material to be heated. The thermal fixing device 141 applies heat and pressure to the recording sheet 201 to thereby fix toner onto the recording sheet 201, and sends the recording sheet 201 onto a discharge tray 145.

Figure 2:
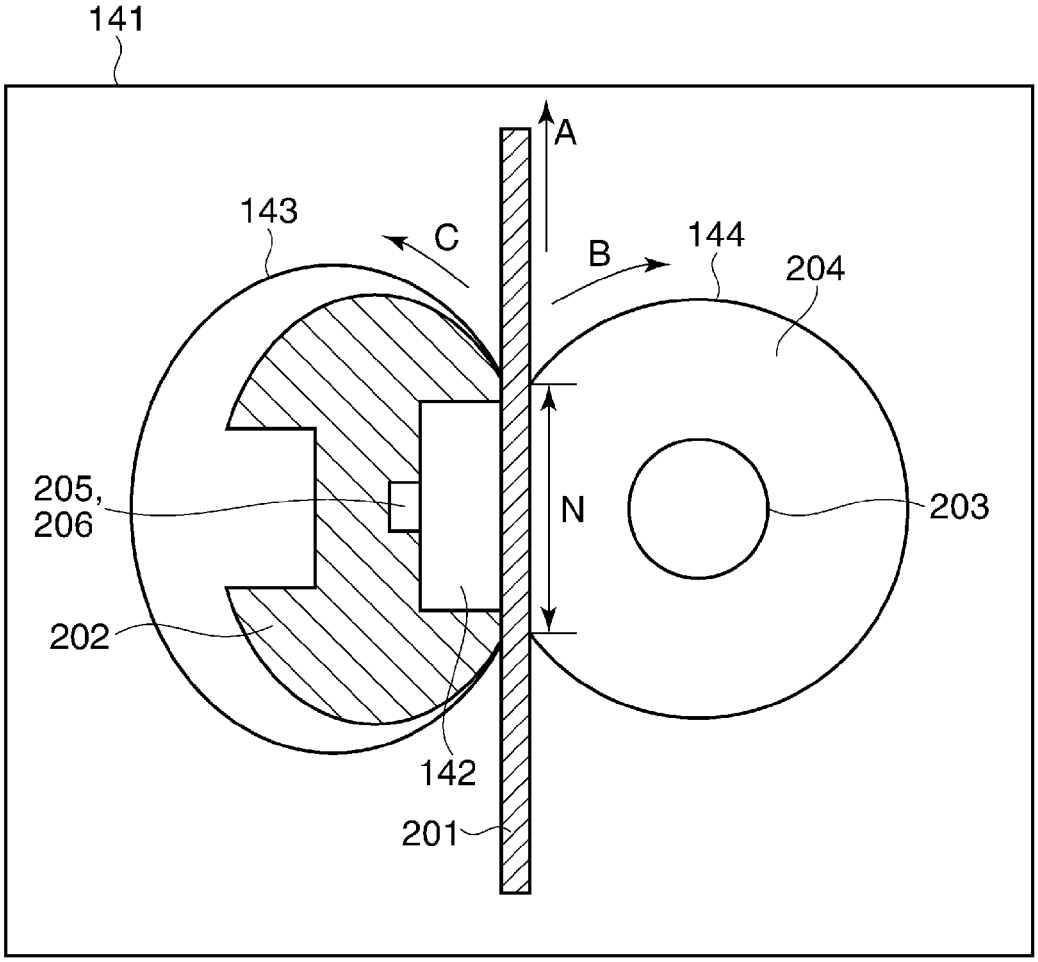
FIG. 2 is a schematic cross-sectional view of a thermal fixing device.

FIG. 2 is a schematic cross-sectional view of the thermal fixing device 141. In FIG. 2, a direction indicated by an arrow A corresponds to a direction in which the recording sheet 201 is conveyed. Therefore, FIG. 2 is a view as viewed from the front side of FIG. 1, i.e. in a direction parallel to the plane of the recording sheet 201 and orthogonal to the sheet conveying direction.

The thermal fixing device 141 includes a heating body 142, a heat-resistant fixing film 143 containing the heating body 142, and a pressure roller 144 as a pressure member disposed in a manner opposed to the fixing film 143 (see FIG. 1 as well). The thermal fixing device 141 further includes a rigid stay 202 and thermistors 205 and 206. The rigid stay 202 is a laterally elongated heat-resistant and heat-insulating member extending longitudinally in a direction transverse to a conveying passage along which the recording sheet 201 is conveyed (i.e. the front-rear direction in FIG. 2). The rigid stay 202 secures the heating body 142 and plays the role of a guide when the inner surface of the fixing film 143 slides.

The heating body 142 is also a laterally elongated member extending longitudinally in the direction transverse to the conveying passage along which the recording sheet 201 is conveyed (i.e. the front-rear direction in FIG. 2). A surface of the rigid stay 202 opposed to the recording sheet 201 is formed with a groove extending in the direction transverse to the conveying passage along which the recording sheet 201 is conveyed (i.e. the front-rear direction in FIG. 2). The heating body 142 is fitted in this groove and fixedly held therein by a heat-resistant adhesive.

The fixing film 143 is a heat-resistant film member having a hollow cylindrical shape, and is loosely fitted on the rigid stay 202 having the heating body 142 mounted therein. The fixing film 143 is a hollow cylindrical single-layer film having a thickness of e.g. 40 to 100 μm and formed e.g. of PTFE, PFA, or FEP having heat resistance, releasability, high strength, and durability. Alternatively, the fixing film 143 may be a multi-layer film formed by coating an outer peripheral surface of a hollow cylindrical film e.g. of polyimide, polyamide, PEEK, PES, or PPS, with PTFE, PFA, FEP, or the like.

The pressure roller 144 is an elastic roller having a heat-resistant elastic layer 204 e.g. of silicone rubber formed on the outer periphery of a core metal part 203 concentrically and integrally with the core metal part 203 such that the elastic layer 204 has a shape of a roller. The fixing film 143 is sandwiched between the pressure roller 144 and the heating body 142 on the rigid stay side, whereby a fixing nip N is formed as an area where the recording paper 201 overlapping the fixing film 143 is brought into pressure contact with the pressure roller 144 having elasticity.

The pressure roller 144 is rotated at a predetermined circumferential speed in a direction indicated by an arrow B. A frictional force generated by rotation of the pressure roller 144 between the pressure roller 144 and the outer peripheral surface of the fixing film 143 at the fixing nip N causes a rotational force to directly act on the fixing film 143. When the recording sheet 201 moves in a direction indicated by an arrow A to be guided into the fixing nip N, the rotational force indirectly acts on the fixing film 143 via the recording sheet 201. With this action, the fixing film 143 moves in contact with the inner surface of the heating body 142. More specifically, the fixing film 143 is rotated in a direction indicated by an arrow C in pressure sliding contact with the heating body 142.

The rigid stay 202 functions as a film inner surface guide member as well to facilitate rotation of the fixing film 143 around the rigid stay 202. A small amount of lubricant, such as heat-resistant grease, may be provided between the inner surface of the fixing film 143 and the surface of the heating body 142 opposed to the pressure roller 144, so as to reduce sliding resistance between the two surfaces.

It is waited that the rotation of the fixing film 143 caused by the rotation of the pressure roller 144 becomes steady, and the temperature of the heating body 142, monitored by the thermistors 205 and 206 disposed at respective locations on the heating body 142 in the longitudinal direction, reaches a predetermined temperature. In a state where the temperature of the heating body 142 has reached the predetermined temperature, when a recording sheet 201 having an image to be fixed is guided in between the fixing film 143 and the pressure roller 144 at the fixing nip N, the recording sheet 201 is heated while being conveyed in a state nipped together with the fixing film 143 between the heating body 142 and the pressure roller 144 at the fixing nip N.

This causes the heat of the heating body 142 to be efficiently transferred to an unfixed image on the recording sheet 201 via the fixing film 143, whereby the unfixed image on the recording sheet 201 is thermally fixed on the recording sheet 201. The recording sheet 201 having passed through the fixing nip N is separated from the surface of the fixing film 143 and is conveyed in the direction indicated by the arrow A.

Figure 3A:
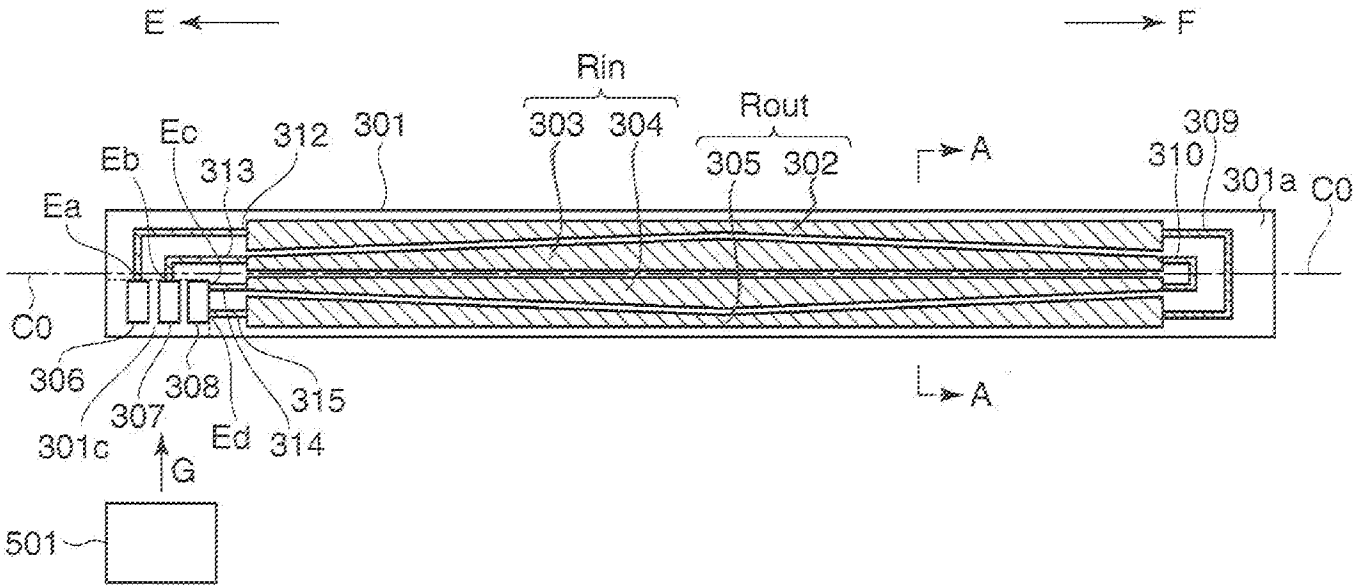
FIG. 3A is a schematic view of a heating body.
Figure 3B:
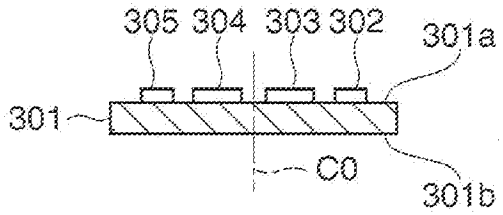
FIG. 3B is a cross-sectional view taken along line A—A of FIG. 3A.

FIG. 3A is a schematic view of the heating body 142 as viewed from the pressure roller side. In FIG. 3A, an E side toward one longitudinal end of the heating body 142 corresponds to the rear in FIG. 2, i.e. a side remote from the viewer, as viewed in FIG. 2, and an F side toward the other longitudinal end of the heating body 142 corresponds to the front in FIG. 2, i.e. a side toward the viewer, as viewed in FIG. 2, but this may be reversed. FIG. 3B is a cross-sectional view taken along line A-A of FIG. 3A. The lateral direction of a substrate 301 of the heating body 142 corresponds to the conveying direction of the recording sheet 201 for thermal fixing.

The plate-like substrate 301 of the heating body 142 extends parallel with the sheet surface of the recording sheet 201 guided into the thermal fixing device 141. The substrate 301 is formed of a ceramic material, such as alumina or aluminum nitride. The substrate 301 has a first surface 301*a* as a main surface thereof and a second surface 301*b* (see FIG. 3B). On the first surface 301*a*, there are formed a plurality of (four in the present example) heating resistors 302 to 305 and a plurality of (three in the present example) contacts 306 to 308 by printing and baking. Each of the heating resistors 302 to 305 is formed e.g. of silver palladium, and generates heat when electric power is supplied thereto. Each of the contacts 306 to 308 is a power-supply electrode serving as an electrical contact with a contact of a connector 501.

The heating resistors 302 to 305 will be generically referred to as "the heating resistor group", and a pair of the heating resistors 303 and 304 (first heating resistor) will be referred to as "the inner heating resistor Rin". Further, a pair of the heating resistors 302 and 305 (second heating resistor) will be referred to as "the outer heating resistor Rout". A predetermined reference position of the substrate 301 in the lateral direction of the substrate 301 is indicated by C0. In the present embodiment, the reference position C0 is identical to the lateral center position of the substrate 301. However, the reference position C0 is not necessarily required to be identical to the center position of the substrate 301, but is only required to be set in advance as a symmetrical center of the heating resistor group.

The heating resistors 303 and 304 of the inner heating resistor Rin are disposed substantially symmetrically with respect to the reference position C0 in the lateral direction of the substrate 301. The heating resistors 302 and 305 of the outer heating resistor Rout are disposed at respective locations farther (outward) from the reference position C0 than the inner heating resistor Rin, substantially symmetrically with respect to the reference position C0 in the lateral direction of the substrate 301. In other words, when the first surface 301*a* of the substrate 301 is viewed from the front thereof, each of the inner heating resistor Rin and the outer heating resistor Rout is disposed line-symmetrically with respect to the reference position C0. Note that "substantial symmetry" includes "perfect symmetry".

The heating resistors 303 and 304 have the same resistance value and the same resistance distribution, and the heating resistors 302 and 305 have the same resistance value and the same resistance distribution. Each of the heating resistors 303 and 304 has a longitudinally intermediate portion thereof wider than the opposite longitudinal ends thereof, whereas each of the heating resistors 302 and 305 has a longitudinally intermediate portion thereof narrower than the opposite longitudinal ends (see FIG. 3A).

Therefore, in each of the heating resistors 303 and 304, the amount of heat generated at the opposite ends is larger than that of heat generated at the intermediate portion, whereas in each of the heating resistors 302 and 305, the amount of heat generated at the intermediate portion is larger than that of heat generated at the opposite ends. However, in each of the inner heating resistor Rin and the outer heating resistor Rout, the above-described symmetrical arrangement of the heating resistors causes the same amount of heat to be generated at locations substantially symmetrical with respect to the reference position C0. The heating resistors 303 and 304 and the heating resistors 302 and 305 are different from each other in resistance distribution and resistance value.

The F-side ends of the physical (positional) opposite ends of the respective heating resistors 303 and 304 in the longitudinal direction are electrically connected by a conductor trace 310 and held in an electrically conductive state. On the other hand, conductor traces 313 and 314 are led out from the E-side ends of the respective heating resistors 303 and 304, respectively. Thus, the heating resistors 303 and 304 are electrically connected in series, so that two electrical ends can be recognized as to the heating resistors 303 and 304, and therefore the ends of the conductor traces 313 and 314 form the electrical ends, indicated by Eb and Ec, respectively.

The F-side ends of the physical opposite ends of the respective heating resistors 302 and 305 in the longitudinal direction are electrically connected by a conductor trace 309 and held in an electrically conductive state. On the other hand, conductor traces 312 and 315 are led out from the E-side ends of the respective heating resistors 302 and 305, respectively. Thus, the heating resistors 302 and 305 are electrically connected in series, so that two electrical ends can be recognized as to the heating resistors 302 and 305, and therefore the ends of the conductor traces 312 and 315 form the electrical ends, indicated by Ea and Ed, respectively.

The contacts 306, 307, and 308 are concentratedly disposed in the E-side end of the substrate 301 in the longitudinal direction. The electrical end Ea of the conductor trace 312 is connected to the contact 306, and the electrical end Eb of the conductor trace 313 is connected to the contact 307. The electrical end Ec of the conductor trace 314 and the electrical end Ed of the conductor trace 315 are both connected to the contact 308. In short, the contact 306 is a power-supply electrode for the outer heating resistor Rout, and the contact 307 is a power-supply electrode for the inner heating resistor Rin. Further, the inner heating resistor Rin and the outer heating resistor Rout have the same potential on an electric circuit, and hence the contact 308 functions as a common electrode for power supply to the inner heating resistor Rin and the outer heating resistor Rout.

The connector 501 is inserted in a direction indicated by an arrow G and is removed in the opposite direction. For each of the contacts 306, 307, and 308, the connector 501 is inserted or removed on the same predetermined side of the substrate 301 with respect to the plane of the substrate 301. More specifically, an area which is parallel with the lateral direction of the substrate 301 and is located on the side of the substrate 301 where the connector 501 is inserted or removed for each of the contacts 306, 307, and 308 is included in an area 301*c*. The four conductor traces 312 to 315 do not pass through the area 301*c*. More specifically, conductive paths between the inner heating resistor Rin and the outer heating resistor Rout and the power-supply electrodes associated therewith are secured in a manner avoiding the area 301*c*.

Assuming that the conductor traces exist in the area 301*c*, when the connector 501 is moved for insertion or removal, it would rub the conductor traces. This could cause damage to the conductor traces. In the present embodiment, however, the area 301*c* of the substrate 301 has no conductor traces and is open to the edge of the substrate 301, and hence it is possible to prevent breakage or the like of the conductor traces to thereby improve reliability of electrical conduction between the connector 501 and the substrate 301. Further, a step e.g. of inserting a protective sheet before insertion of the connector so as to prevent breakage of the conductor traces can be dispensed with, which contributes to improvement of workability as well.

Figure 4:
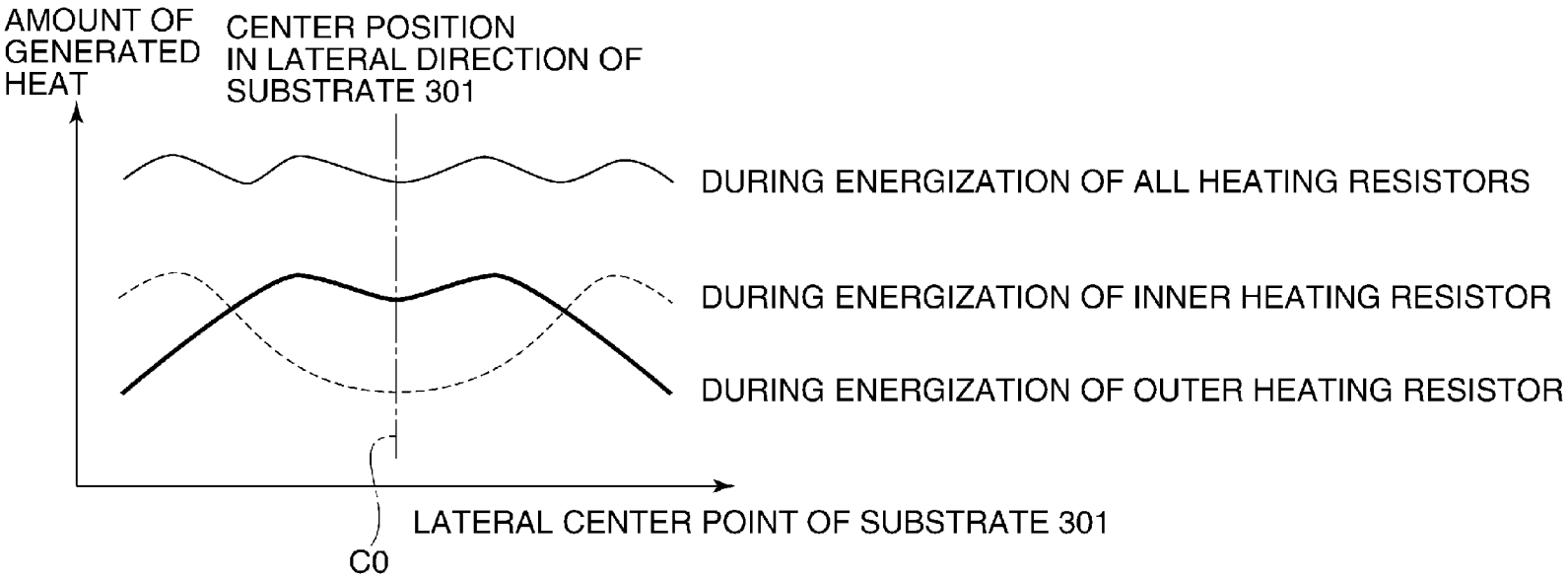
FIG. 4 is a diagram of temperature distribution on a cross section of the substrate taken along line A—A of FIG. 3A.

FIG. 4 is a diagram of temperature distribution on a cross section of the substrate 301 taken along line A—A of FIG. 3A.

As shown in FIG. 4, when all the heating resistors (i.e. the whole heating resistor group) are energized, temperature difference on the substrate 301 in the lateral direction is small. In addition, since the heating resistors 302 to 305 are symmetrically arranged, even when only the inner heating resistor Rin (i.e. the heating resistors 303 and 304) is energized, temperature difference in the lateral direction of the substrate 301 does not become so large. Similarly, even when only the outer heating resistor Rout (i.e. the heating resistors 302 and 305) is energized, temperature difference on the substrate 301 in the lateral direction does not become so large.

For this reason, even if only one of the circuit of the inner heating resistor Rin and that of the outer heating resistor Rout happens to run away to be energized, since the temperature difference is small, thermal stress caused by the temperature difference is small, so that it takes long for the heating body 142 to be deformed or broken. This makes it possible to simplify the construction of a safety circuit that uses a safety element and so forth.

Figure 5:
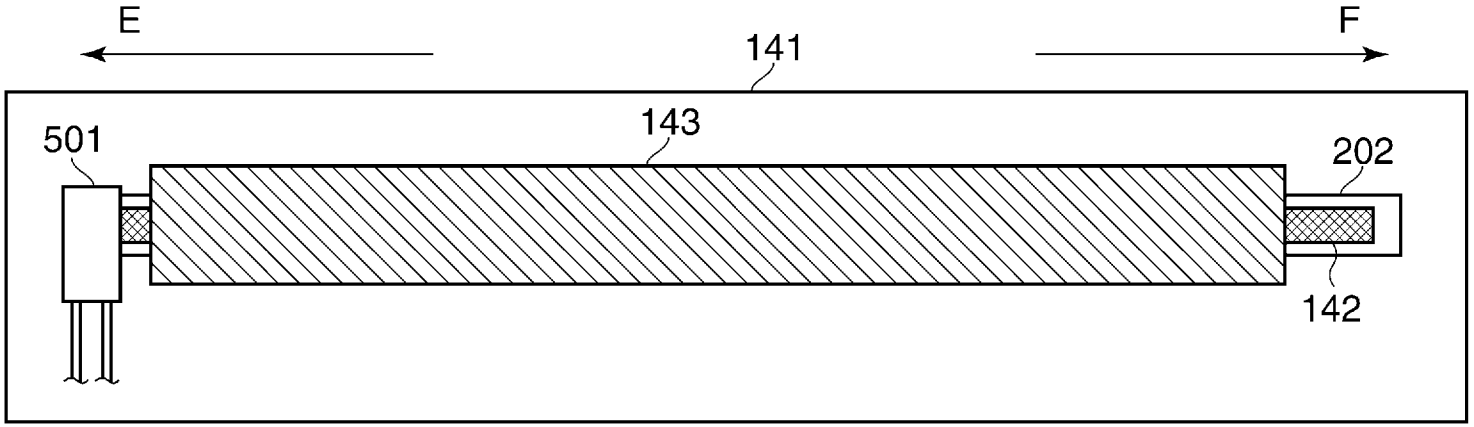
FIG. 5 is a schematic view of the thermal fixing device, as viewed from inside a fixing film toward a pressure roller.

FIG. 5 is a schematic view of the thermal fixing device 141, as viewed toward the pressure roller 144 from inside the fixing film 143.

As described above, differently from the conventional arrangement, all the contacts 306, 307, and 308 are concentratedly disposed in the longitudinal one end (E-side end) of the substrate 301. Therefore, the connector 501 is provided in the E-side end of the thermal fixing device 141, but it is not necessary to provide a connector in the F-side end.

The fixing film 143 is mounted onto the rigid stay 202 from the F-side end and is disposed such that it covers the rigid stay 202. In the case of removing the fixing film 143 e.g. for replacement, the fixing film 143 is removed from the F-side end. Since no connector exists in the F-side end, the fixing film 143 cannot interfere with a connector during work for mounting or removal of the fixing film 143, which makes the work very easy. Thus, the mountability and replaceability of the fixing film 143 is improved.

Figure 6:
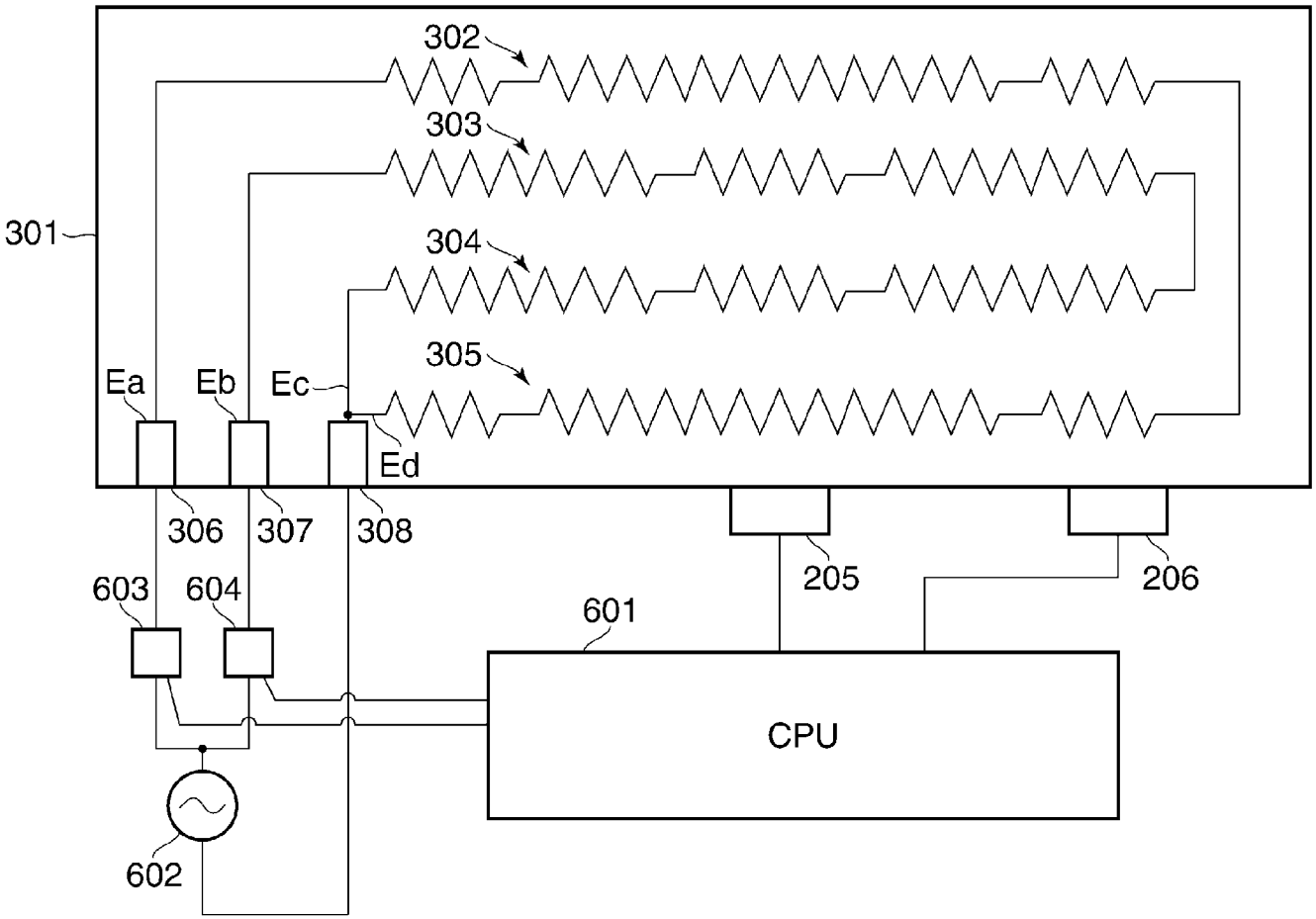
FIG. 6 is a schematic wiring diagram of electrical connection between the heating body and elements associated therewith.

FIG. 6 is a schematic wiring diagram of electrical connection between the heating body 142 and elements associated therewith.

As described hereinabove, each of the heating resistors 302 and 305 (the outer heating resistor Rout) generates a larger amount of heat at its intermediate portion in the longitudinal direction of the heating body 142, and each of the heating resistors 303 and 304 (the inner heating resistor Rin) generates a larger amount of heat at its opposite ends in the longitudinal direction of the heating body 142.

The thermistor 205 is disposed at a central portion of the heating body 142 in the longitudinal direction, and the thermistor 206 is disposed at an end of the heating body 142 in the longitudinal direction. A CPU 601 receives detection signals from the respective thermistors 205 and 206 to thereby monitor the temperatures of the central portion of the heating body 142 and the end of the same in the longitudinal direction.

Based on the monitored temperatures, the CPU 601 controls an energization ratio between the electric circuit of a circuit breaking device 603 for controlling power supply to the heating resistors 302 and 305 from a commercial power source 602 and the electric circuit of a circuit breaking device 604 for controlling power supply to the heating resistors 303 and 304 from the commercial power source 602. Note that a protection device (not shown) for preventing over-temperature is provided between the commercial power source 602 and the contact 308.

Figure 7:
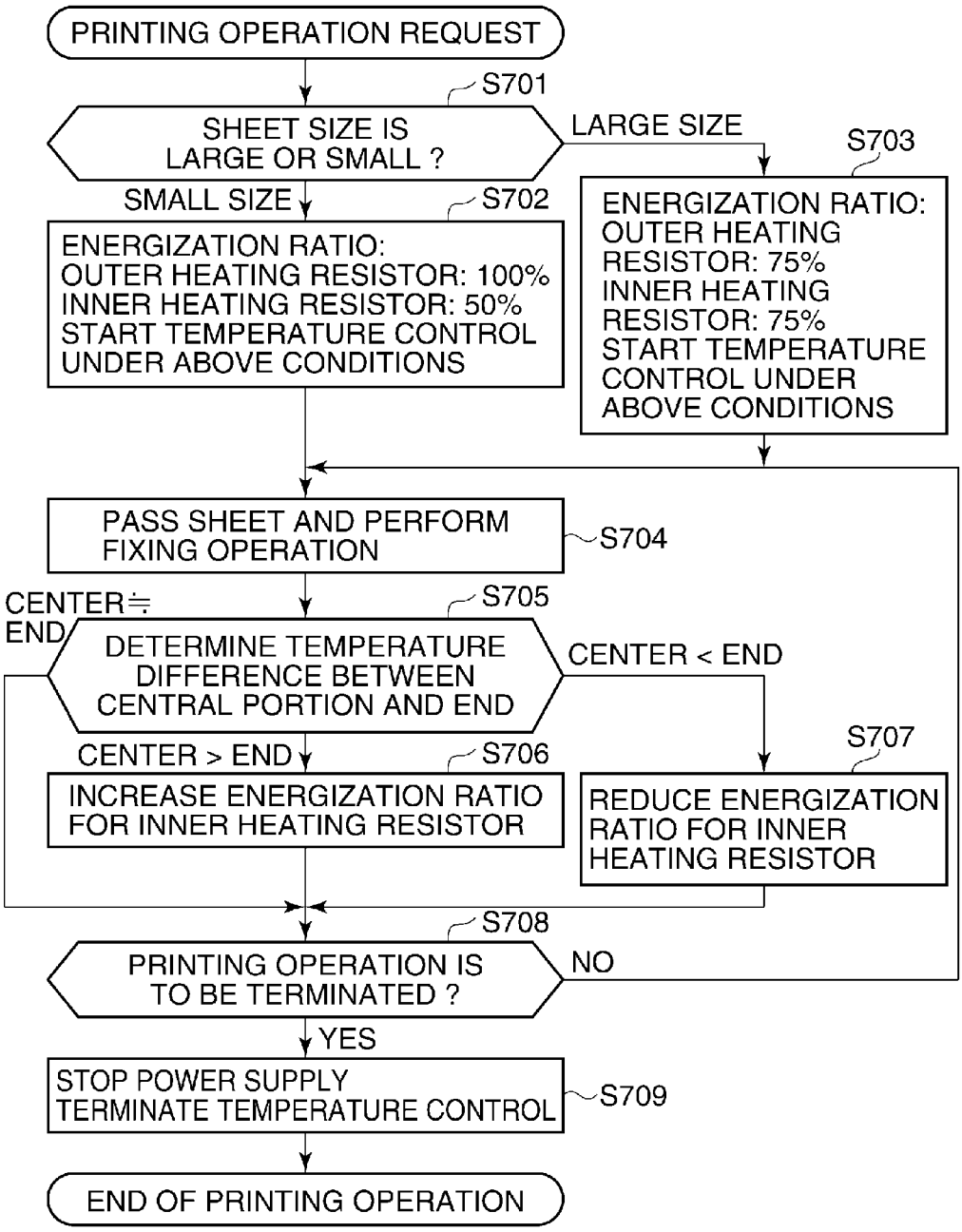
FIG. 7 is a flowchart of a power supply control process executed when a printing operation is requested.

FIG. 7 is a flowchart of a power supply control process executed when a printing operation is requested.

When a printing operation request is issued to the CPU 601 that controls printing operation, the CPU 601 determines the size of a recording sheet 201 to be passed, based on an output from the sheet size sensor 120 (see FIG. 1) (step S701).

For example, when the recording sheet 201 has a width of 270 mm or more in the longitudinal direction of the heating body 142, the recording sheet 201 is determined as large-size, and when the width is less than 270 mm, the recording sheet 201 is determined as small-size. Then, the CPU 601 starts temperature control by controlling the circuit breaking devices 603 and 604 according to the size of the recording sheet 201. If the recording sheet 201 is small-size, the CPU 601 proceeds to a step S702, wherein the CPU 601 controls the circuit breaking device 603 to energize the outer heating resistor Rout at an energization ratio of 100% and controls the circuit breaking device 604 to energize the inner heating resistor Rin at an energization ratio of 50%. This makes it possible to achieve temperature control for preventing over-temperature of non-passed portions where the recording sheet 201 does not pass (corresponding to the ends of the heating body 142).

On the other hand, when the recording sheet 201 is large-size, the recording sheet 201 passes the substantially entire surface of the heating body 142. In this case, the CPU 601 controls the circuit breaking devices 603 and 604 to energize both the outer heating resistor Rout and the inner heating resistor Rin at a uniform energization ratio of 75% (step S703). This makes it possible to achieve temperature control for eliminating temperature unevenness on the surface of the heating body 142.

Then, the CPU 601 performs control such that the recording sheet 201 is passed through the thermal fixing device 141 and an image on the recording sheet 201 is thermally fixed (step S704). In accordance with the passage of the recording sheet 201, the CPU 601 monitors an output from each of the thermistors 205 and 206 and compares between the two outputs to thereby determine a temperature difference between the central portion and the end of the heating body 142 in the longitudinal direction (step S705).

If the CPU 601 determines, based on the result of the comparison, that the temperature difference between the central portion and the end is within a predetermined range, i.e. the temperature of the central portion and that of the end are approximately equal, the CPU 601 proceeds to a step S708. In this case, the energization ratio is held unchanged.

If the temperature of the central portion is higher than that of the end, the CPU 601 performs control such that the energization ratio for the inner heating resistor Rin is slightly increased (e.g. by 5%) (step S706). As a consequence, the temperature of the end rises relative to that of the central portion. On the other hand, if the temperature of the end is higher than that of the central portion, the CPU 601 performs control such that the energization ratio for the inner heating resistor Rin is slightly reduced (e.g. by 5%) (step S707). As a consequence, the temperature of the end falls relative to that of the central portion.

The CPU 601 repeatedly carries out the above-described processing routine (NO to a step S708) until the printing operation is terminated. If the printing operation is to be terminated (YES to the step S708), power supply to the heating resistor group is all stopped, followed by terminating the temperature control (step S709). Then, the present printing operation is terminated. By executing the above-described control, the temperature difference between the central portion and the end of the heating body 142 is reduced during normal temperature control for the heating body 142.

According to the present embodiment, each of the inner heating resistor Rin and the outer heating resistor Rout is substantially symmetrical with respect to the reference position C0, and the contacts 307 and 308 are connected to the respective electrical ends Eb and Ec of the inner heating resistor Rin and the contacts 306 and 308 to the respective electrical ends Ea and Ed of the outer heating resistor Rout. Further, all these contacts 306 to 308 are concentratedly disposed on the one end side (E side) of the substrate 301 in the longitudinal direction. This makes it possible to facilitate mounting and removal (attachment and replacement) of the fixing film 143.

Further, since the contact 308 functions as a common power-supply electrode for the inner heating resistor Rin and the outer heating resistor Rout, it is possible to simplify the construction of the thermal fixing device, which contributes to cost reduction.

Furthermore, the conductive paths between the power-supply electrodes of the inner heating resistor Rin and the outer heating resistor Rout are arranged in a manner avoiding the area 301*c* where the connector 501 is moved for connector insertion and removal. Therefore, there is no fear of the conductive paths being damaged by insertion or removal of the connector 501.

Although each of the inner heating resistor Rin as a first heating resistor and the outer heating resistor Rout as a second heating resistor comprises a pair of heating resistors, i.e. two heating resistors, the number of the heating resistors may be other than two insofar as they are arranged substantially symmetrically with respect to the reference position C0 in the lateral direction of the substrate 301. However, the power-supply electrodes provided at the respective two electrical ends of the first heating resistor and the power-supply electrodes provided at the respective two electrical ends of the second heating resistor are required to be all disposed on the one end side of the substrate 301 in the longitudinal direction. Further, on the other end side of the substrate 301 in the longitudinal direction, the end of the first heating resistor and that of the second heating resistor are required not to be electrically conducted to each other. FIGS. 8A and 8B and 9A to 9E show variations satisfying the above-mentioned conditions.

FIGS. 8A and 8B and 9A to 9D are schematic views showing variations of the heating resistor group. FIGS. 8A and 8B and 9A and 9C correspond to respective front views of the first surface 301*a* of the substrate 301 incorporating the variations of the heating resistor group, and the directions (E side and F side) in FIGS. 8A and 8B and 9A and 9C are identical to those in FIG. 3A. In these variations, each of heating resistors has a uniform width in the longitudinal direction, but the width may be non-uniform in the longitudinal direction similarly to the example shown in FIG. 3A.

Figure 8A:
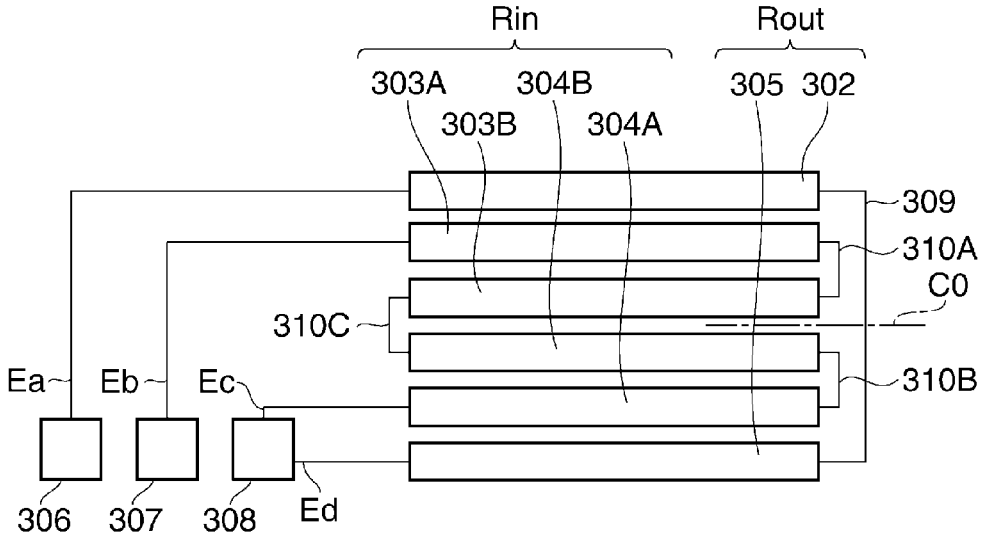
FIGS. 8A and 8B are schematic views of variations of a heating resistor group.

As shown in FIG. 8A, the inner heating resistor Rin may be formed not by two heating resistors but by four heating resistors. In this case, a heating resistor 303A and a heating resistor 303B have F-side (right side, as viewed in FIG. 8A) longitudinal ends thereof electrically conducted to each other by a conductor trace 310A. A heating resistor 304A and a heating resistor 304B have F-side longitudinal ends thereof electrically conducted to each other by a conductor trace 310B. Further, the heating resistor 303B and the heating resistor 304B have E-side ends thereof electrically conducted to each other by a conductor trace 310C.

Thus, the four heating resistors 303A, 303B, 304B, and 304A are electrically connected in series, and the contacts 307 and 308 are connected to the respective two electrical ends Eb and Ec of the serially connected four heating resistors of the inner heating resistor Rin. The inner heating resistor Rin is substantially symmetrical with respect to the reference position C0. The arrangement of the outer heating resistor Rout and the locations of the respective contacts 306, 307, and 308 are the same as in the FIG. 3A example. Therefore, the arrangement in FIG. 8A can provide the same advantageous effects as provided by the arrangement in FIG. 3A.

Figure 8B:
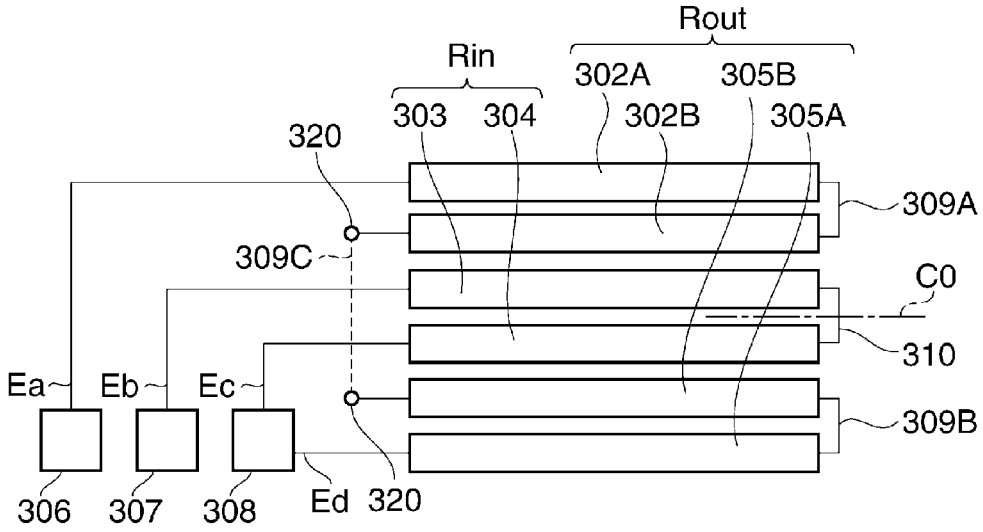

In another variation, as shown in FIG. 8B, the outer heating resistor Rout may be formed by the four heating resistors 302A, 302B, 305A, and 305B such that the heating resistors 302A and 302B and the heating resistors 305A and 305B are arranged substantially symmetrically with respect to the reference position C0. These heating resistors 302A, 302B, 305B, and 305A are connected in series by conductor traces 309A, 309C, and 309B. In this variation, the conductor trace 309C electrically conducts between the heating resistors 302B and 305B, on the second surface 301*b* via through holes 320 in the E-side end.

Figure 9A:
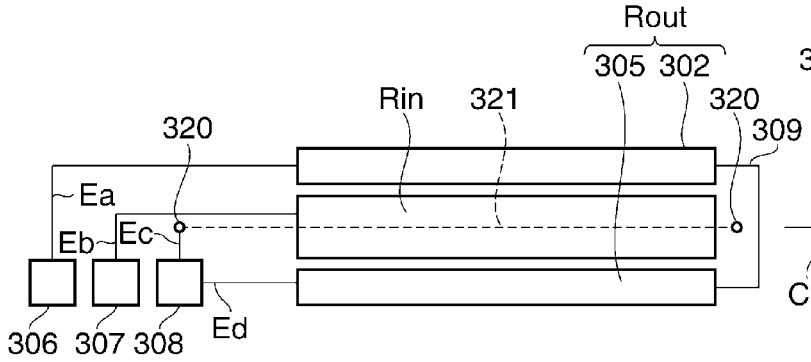
FIGS. 9A to 9E are schematic views of variations of the heating resistor group and variations of contact arrangement.
Figure 9B:
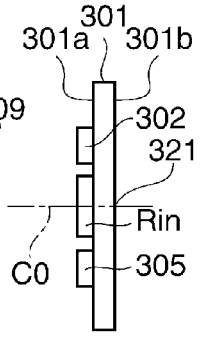
Figure 9C:
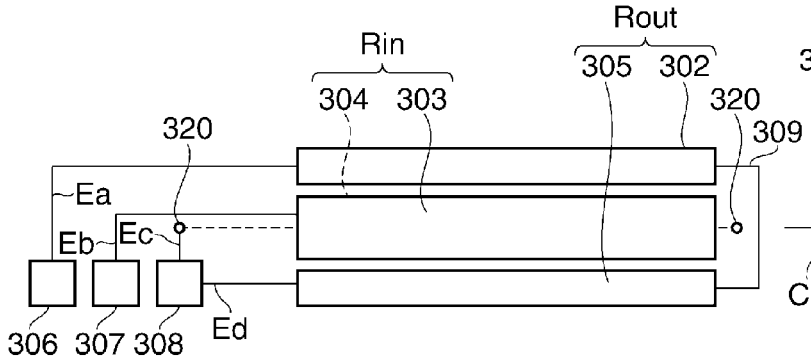
Figure 9D:
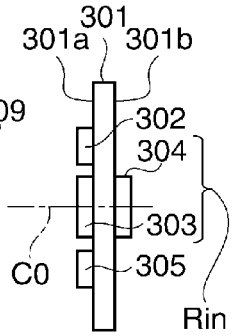

FIGS. 9B and 9D are schematic cross-sectional views of respective heating resistor groups shown in FIGS. 9A and 9C, taken along the lateral direction of the substrate 301.

In the variation shown in FIGS. 9A and 9B, the inner heating resistor Rin is formed by a single heating resistor alone, which is provided on the first surface 301*a* of the substrate 301 in a manner substantially symmetrical with respect to the reference position C0. Using a conductor trace 321, the two electrical ends Eb and Ec are configured to be located in the E-side (left side, as viewed in FIGS. 9A and 9B) end.

More specifically, between the F-side end and the E-side end, the conductor trace 321 is extended to the E side along the reference position C0 on the second surface 301*b* of the substrate 301 and via the two through holes 320 formed in the F-side end and the E-side end, respectively, for electrical conduction. One end of the conductor trace 321 forms the electrical end Ec which is connected to the contact 308. The arrangement of the outer heating resistor Rout and the locations of the respective contacts 306, 307, and 308 are the same as in the FIG. 3A example.

In a variation shown in FIGS. 9C and 9D, the inner heating resistor Rin is formed by two heating resistors 303 and 304 provided on the respective first and second surfaces 301*a* and 301*b* of the substrate 301 and each disposed in a manner substantially symmetrical with respect to the reference position C0. In this example, the heating resistors 303 and 304 are also symmetrical with respect to the substrate 301. The heating resistors 303 and 304 are electrically conducted to each other at the F-side end via the through hole 320. The heating resistor 304 on the second surface 301*b* is electrically conducted to the contact 308 via the through hole 320 in the E-side end. The arrangement of the outer heating resistor Rout and the locations of the respective contacts 306, 307, and 308 are the same as in the FIG. 3A example.

As described above, the two surfaces of the substrate 301 may be used for arrangement of the heating resistors, which enhances the degree of freedom in design for satisfying the above-described conditions concerning the symmetric property and the arrangement of the power-supply electrodes.

Figure 9E:
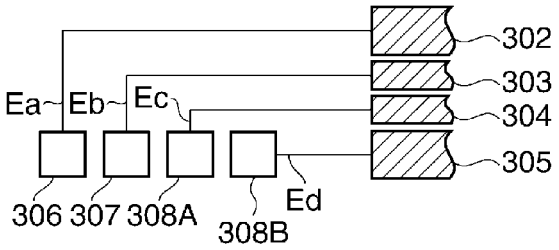

Further, as shown in FIG. 9E, there may be provided four power-supply electrodes that are connected separately to the electrical ends Ea and Ed of the outer heating resistor Rout and the electrical ends Eb and Ec of the inner heating resistor Rin, respectively. More specifically, from the viewpoint of facilitating mounting and removal of the fixing film 143, it is not essential to connect the contact 308 to the common electrode, but the contact 308 may be divided into two contacts 308A and 308B, for respective electrical connections, as shown in FIG. 9E.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2011-092972 filed Apr. 19, 2011, which is hereby incorporated by reference herein in its entirety.

What is claimed is:

1. A heating device for heating a toner image on a sheet via a fixing film, comprising:

a substrate disposed such that a first direction of the substrate orthogonal to a conveying direction of the fixing film is longitudinal;

a first heating member formed by first and second heating resistors that are disposed in a manner substantially symmetrical with respect to a predetermined reference position in a second direction orthogonal to the first direction of said substrate; and a second heating member formed by third and fourth heating resistors that are disposed farther from the reference position in the second direction of said substrate than said first and second heating resistors and that are arranged in a manner substantially symmetrical with respect to the reference position, said second heating member being capable of generating heat independently of said first heating member, wherein power-supply electrodes connected to said first heating member and power-supply electrodes connected to said second heating member are all disposed at one end of said substrate in the longitudinal direction, wherein an end of said first heating member and an end of said second heating member, which are located at the other end of said substrate in the first direction, are configured not to be electrically conducted to each other, wherein in said second heating member, ends of the third and fourth heating resistors located at the other end of said substrate in the first direction are electrically conducted to each other, and wherein said first heating member and said second heating member are configured to be capable of concurrently receiving power, causing said first heating member and said second heating member to be capable of concurrently generating heat.

2. The heating device according to claim 1, wherein ends of the first and second heating resistors located at the other end of said substrate in the first direction are electrically conducted to each other.

3. The heating device according to claim 2, wherein one of the first and second heating resistors, one of the third and fourth heating resistors, the power-supply electrodes connected to said first heating member, and the power-supply electrodes connected to said second heating member are all disposed on the same side of the reference position.

4. The heating device according to claim 2, wherein each of the third and fourth heating resistors has a longitudinally intermediate portion thereof that is narrower than opposite longitudinal ends thereof, and each of the first and second heating resistors has a longitudinally intermediate portion thereof that is wider than opposite longitudinal ends thereof.

5. The heating device according to claim 1, wherein each of said first and second heating members generates the same amount of heat at substantially symmetrical portions thereof with respect to the reference position.

6. The heating device according to claim 1, wherein an area of said substrate on a side of a connector being inserted into or removed from the power supply electrodes has no conductor trace connecting between the first and second heating members.

7. The heating device according to claim 1, wherein one of the third and fourth heating resistors, the power-supply electrodes connected to said first heating member, and the power-supply electrodes connected to said second heating member are all disposed on the same side of the reference position.

8. The heating device according to claim 1, wherein each of the third and fourth heating resistors has a longitudinally intermediate portion thereof that is narrower than opposite longitudinal ends thereof.

9. The heating device according to claim 1, further comprising a processor connected to said power-supply electrodes connected to said first heating member and to said power-supply electrodes connected to said second heating member, said processor being configured to be capable of concurrently supplying power to said power-supply electrodes connected to said first heating member and to said power-supply electrodes connected to said second heating member.

10. The heating device according to claim 1, wherein the first heating resistor and the third heating resistor are adjacent to each other in the second direction, and the second heating resistor and the fourth heating resistor are adjacent to each other in the second direction.

11. A heating device for heating a toner image on a sheet via a fixing film, comprising:

a substrate disposed such that a first direction of the substrate orthogonal to a conveying direction of the fixing film is longitudinal;

a first heating member formed by at least one heating resistor that is disposed in a manner substantially symmetrical with respect to a predetermined reference position in a second direction orthogonal to the first direction of said substrate; and a second heating member formed by two heating resistors that are disposed farther from the reference position in the second direction of said substrate than said at least one heating resistor that is arranged in a manner substantially symmetrical with respect to the reference position, said second heating member being capable of generating heat independently of said first heating member, wherein power-supply electrodes connected to said first heating member and power-supply electrodes connected to said second heating member are all disposed at one end of said substrate in the longitudinal direction, wherein an end of said first heating member and an end of said second heating member, which are located at the other end of said substrate in the first direction, are configured not to be electrically conducted to each other, wherein in said second heating member, ends of the two heating resistors located at the other end of said substrate in the first direction are electrically conducted to each other, and wherein one of power-supply electrodes connected to said first heating member and one of power-supply electrodes connected to said second heating member form a common electrode.

12. The heating device according to claim 11, wherein one of power-supply electrodes connected to said first heating member and one of power-supply electrodes connected to said second heating member are spaced apart from each other.

* * * * *